US006425152B1

(12) United States Patent
Quarles

(10) Patent No.: US 6,425,152 B1
(45) Date of Patent: Jul. 30, 2002

(54) INFANT SUPPORT ASSEMBLY

(76) Inventor: Thomas L. Quarles, 710 SW. Fairlon Ave. Apt. #208A, Topeka, KS (US) 66605

( * ) Notice: Subject to any disclaimer, the term of this patent is extended or adjusted under 35 U.S.C. 154(b) by 6 days.

(21) Appl. No.: 09/671,898

(22) Filed: Sep. 28, 2000

(51) Int. Cl.[7] ..... A47D 7/00
(52) U.S. Cl. ..... 5/655; 5/724; 5/98.3
(58) Field of Search ..... 5/655, 724, 652.1, 5/98.3; 4/572.1, 573.1

(56) References Cited

U.S. PATENT DOCUMENTS 961,669 A 6/1910 Atkinson
1,279,944 A 9/1918 Tolman
2,587,255 A * 2/1952 Vogel et al. ..... 5/98.3
D184,347 S 2/1959 Gevertz
3,735,430 A 5/1973 Platz
5,349,709 A 9/1994 Cheng
5,555,577 A 9/1996 Volpe
5,561,876 A * 10/1996 Petruzella ..... 5/724
5,855,031 A * 1/1999 Swift ..... 5/93.1

* cited by examiner

*Primary Examiner*—Jack Lavinder
*Assistant Examiner*—Fredrick Conley

(57) ABSTRACT

An infant support assembly for supporting an infant using a mesh material to permit free flow of air around the infant to minimize the potential for smothering of the infant. The infant support assembly includes a frame assembly and a mesh material coupled to the frame assembly to form a support surface. Additionally, mesh side rails are provided for facilitating retention of an infant on the support surface.

15 Claims, 3 Drawing Sheets

INFANT SUPPORT ASSEMBLY

BACKGROUND OF THE INVENTION

1. Field of the Invention

The present invention relates to infant beds and more particularly pertains to a new infant support assembly for supporting an infant using a mesh material to permit free flow of air around the infant to minimize the potential for smothering of the infant.

2. Description of the Prior Art

The use of infant beds is known in the prior art. More specifically, infant beds heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,555,577; 1,279,944; 961,669; 5,349,709; U.S. Pat. No. Des. 184,347; and U.S. Pat. No. 3,735,430.

While these devices fulfill their respective, particular objectives and requirements, the aforementioned patents do not disclose a new infant support assembly. The inventive device includes a frame assembly and a mesh material coupled to the frame assembly to form a support surface. Additionally, mesh side rails are provided for facilitating retention of an infant on the support surface.

In these respects, the infant support assembly according to the present invention substantially departs from the conventional concepts and designs of the prior art, and in so doing provides an apparatus primarily developed for the purpose of supporting an infant using a mesh material to permit free flow of air around the infant to minimize the potential for smothering of the infant.

SUMMARY OF THE INVENTION

In view of the foregoing disadvantages inherent in the known types of infant beds now present in the prior art, the present invention provides a new infant support assembly construction wherein the same can be utilized for supporting an infant using a mesh material to permit free flow of air around the infant to minimize the potential for smothering of the infant.

The general purpose of the present invention, which will be described subsequently in greater detail, is to provide a new infant support assembly apparatus and method which has many of the advantages of the infant beds mentioned heretofore and many novel features that result in a new infant support assembly which is not anticipated, rendered obvious, suggested, or even implied by any of the prior art infant beds, either alone or in any combination thereof.

To attain this, the present invention generally comprises a frame assembly and a mesh material coupled to the frame assembly to form a support surface. Additionally, mesh side rails are provided for facilitating retention of an infant on the support surface.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new infant support assembly apparatus and method which has many of the advantages of the infant beds mentioned heretofore and many novel features that result in a new infant support assembly which is not anticipated, rendered obvious, suggested, or even implied by any of the prior art infant beds, either alone or in any combination thereof.

It is another object of the present invention to provide a new infant support assembly that may be easily and efficiently manufactured and marketed.

It is a further object of the present invention to provide a new infant support assembly that is of a durable and reliable construction.

An even further object of the present invention is to provide a new infant support assembly which is susceptible of a low cost of manufacture with regard to both materials and labor, and which accordingly is then susceptible of low prices of sale to the consuming public, thereby making such infant support assembly economically available to the buying public.

Still yet another object of the present invention is to provide a new infant support assembly which provides in the apparatuses and methods of the prior art some of the advantages thereof, while simultaneously overcoming some of the disadvantages normally associated therewith.

Still another object of the present invention is to provide a new infant support assembly for supporting an infant using a mesh material to permit free flow of air around the infant to minimize the potential for smothering of the infant.

Yet another object of the present invention is to provide a new infant support assembly which includes a frame assembly and a mesh material coupled to the frame assembly to form a support surface. Additionally, mesh side rails are provided for facilitating retention of an infant on the support surface.

Still yet another object of the present invention is to provide a new infant support assembly that permits free flow of air around the infant to facilitate breathing by the infant during sleep.

Even still another object of the present invention is to provide a new infant support assembly that permits free flow of air around an infant, which is believed to reduce the possibility of sudden infant death syndrome (SIDS).

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
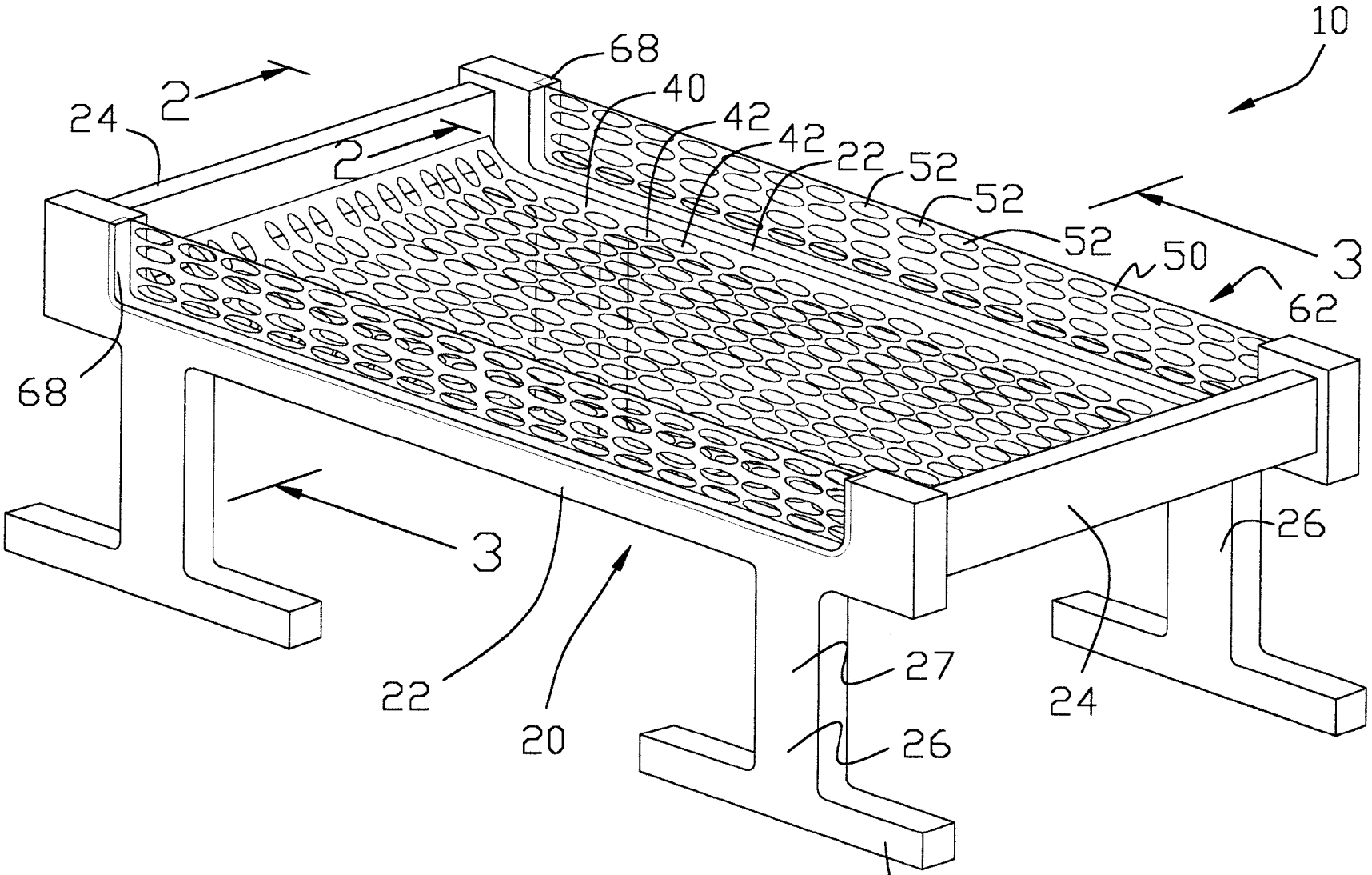
FIG. 1 is a perspective view of a new infant support assembly according to the present invention.
Figure 2:
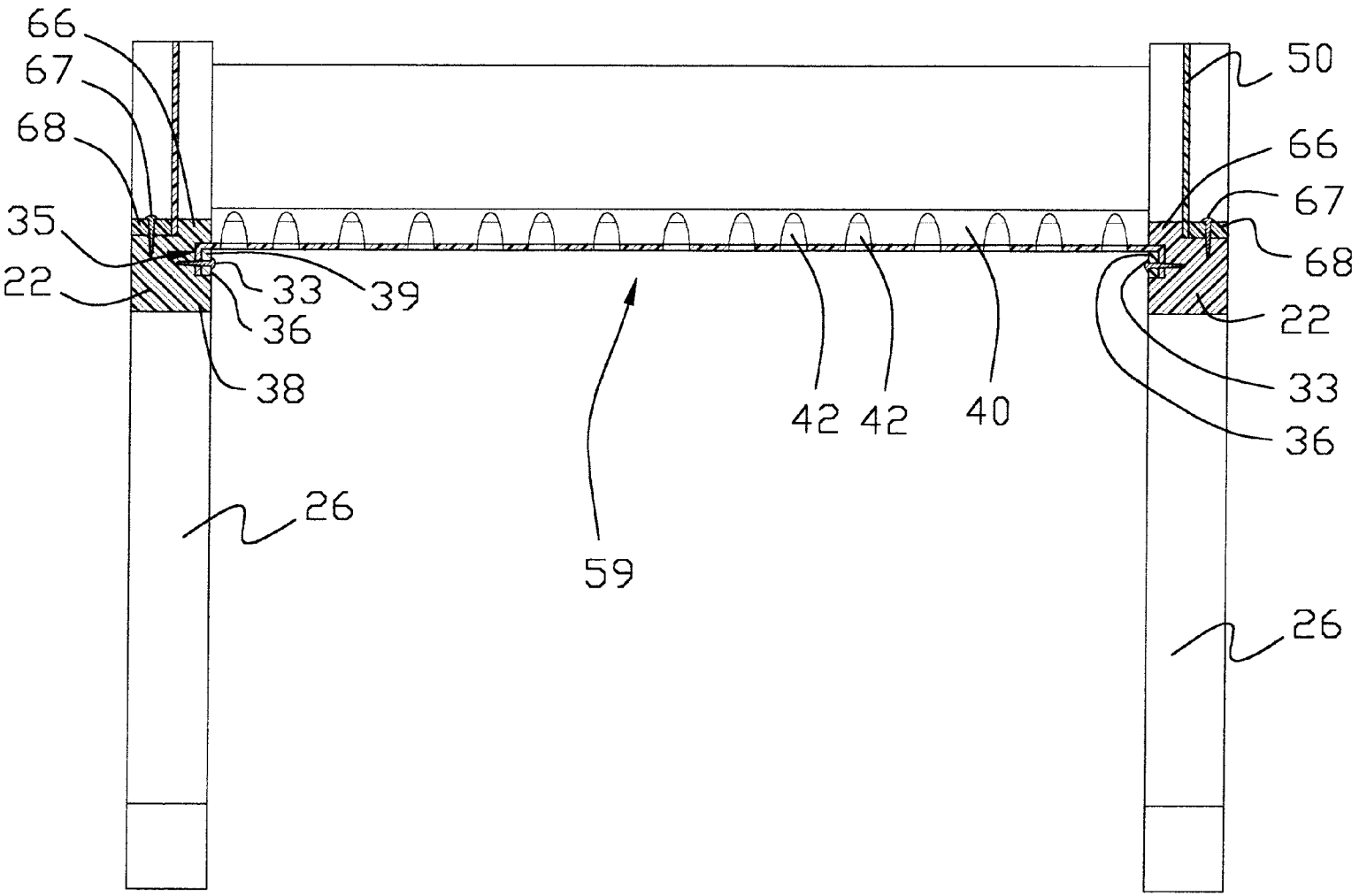
FIG. 2 is a partial cross-sectional view taken along line 2-2 of FIG. 1.
Figure 3:
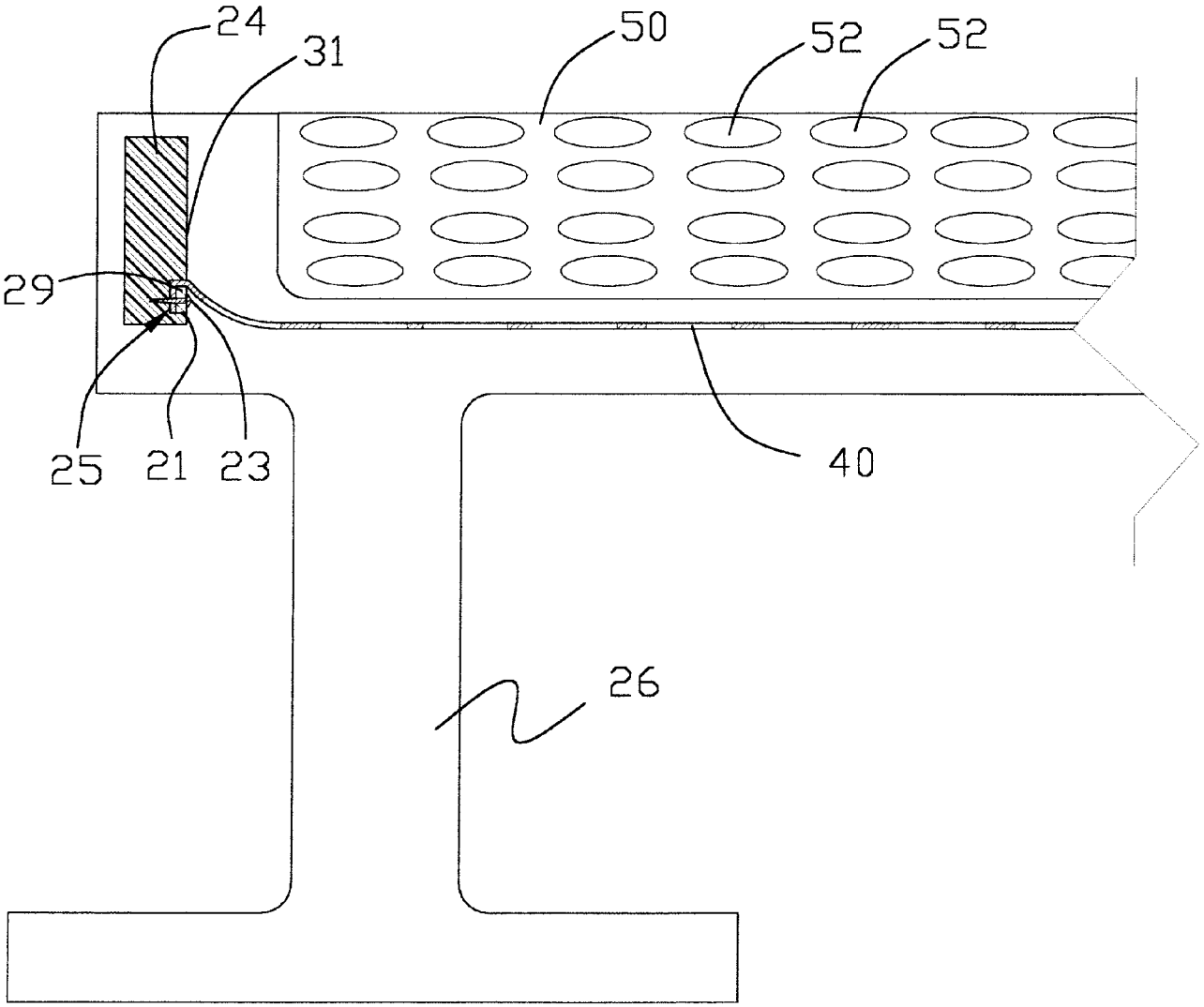
FIG. 3 is a partial cross-sectional view taken along line 3-3 of FIG. 1.

With reference now to the drawings, and in particular to FIGS. 1 through 3 thereof, a new infant support assembly embodying the principles and concepts of the present invention and generally designated by the reference numeral 10 will be described.

As best illustrated in FIGS. 1 through 3, the infant support assembly 10 generally comprises a frame assembly 20 and a support member 40. The support member 40 is coupled to the frame assembly 20 such that the support assembly is positioned for supporting an infant in spaced relationship to a surface supporting the frame assembly 20.

The support member 40 has a plurality of apertures 42 for facilitating free flow of air through the support member 40. A pair of side panels 50 are also provided and coupled to the frame assembly 20. Each side panel 50 has a plurality of apertures 52 for facilitating free flow of air through the side members 50.

The frame assembly 20 includes a pair of longitudinal side members 22 and a pair of cross members 24 that extend between associated ends of the side members 22 to define an opening 59 in the frame assembly 20. The support member 40 is coupled to the cross members 24 such that the support member 40 is positioned in the opening 59 in the frame assembly 20.

The support member has longitudinal sides 44 coupled to the side members 22 of the frame assembly 20.

In an embodiment, the support member 40 is constructed from a flexible inelastic sheet of material such as nylon. The support member 40 should be constructed of a pliable and preferably soft material for comfortably supporting the infant without additional materials being placed on the support member 40 with the infant. Thus, nothing is provided to obstruct breathing of the infant regardless of the position of the infant on the support member 40.

The frame assembly 20 has a plurality of leg members 26. In an embodiment, each of the leg members 26 extends downwardly from an underside of an associated one of the longitudinal side members 22. Each of the leg members 26 has an extension portion 27 and a support portion 28. The extension portion 27 extends outwardly from a medial portion of the support portion 28. Thus, each leg member 26 is generally T-shaped. Each support portion 28 has a longitudinal axis that extends parallel to a longitudinal axis of the associated one of the longitudinal side members 22.

Each cross member 24 has a cross member slot 25. An associated end of the support member 40 is positioned in the cross member slot 24. A pair of end connection members 29 are provided. Each end connection member 29 is insertable into an associated one of the cross member slots 25. A plurality of end connectors 23 are provided for coupling the end connection members 29 to their associated one of the cross members 24 such that the associated end of the support member 40 is clamped between the cross member 24 and the associated end connection member 29. Thus, each end of the support member 40 is coupled to the frame assembly 40. In an embodiment, each cross member slot 25 extends a full length between the side members 22 and each associated end of the support member 40 is positioned to extend the full length between the side members 22. Thus, a full length of each end of the support member 40 is coupled to the frame assembly 20.

Similarly, each longitudinal side member 22 has a side member slot 35. An associated side of the support member 40 is positioned in each side member slot 35. A pair of side connection members 36 are each insertable into an associated one of the side member slots 35. A plurality of side connectors 33 are provided for coupling an associated one of the side connection members 36 to the associated one of the side members 22 such that the associated side of the support member 40 is clamped between the side member 22 and the associated side connection member 36. Thus, each side of the support member 40 is coupled to the frame assembly 40. Each side member slot 35 extends a full length between the cross members 24. Each associated side of the support member 40 is positioned to extend the full length between the cross members 24. Thus, a full length of each side of the support member 40 is coupled to the frame assembly 20.

Most preferably, each end connection member 29 fits into the associated cross member slot 25 such that an exterior face 21 of the end connection member 29 is flush with a face 31 of the cross member 24 when the end connection member 29 is coupled to the cross member 24.

Similarly, each side connection member 36 fits into the associated side member slot 35 such that an exterior face 39 of the side connection member 36 is flush with a face 38 of the side member 22 when the side connection member 36 is coupled to the side member 22.

Each side member 22 further has a generally U-shaped cutout portion 62 that extends along a medial portion of the side member 22.

Each side panel 50 is positioned in the U-shaped cutout portion 62 of an associated one of the side members 22. Each side member 22 has a ridge 66 that extends into the cutout portion 62. Each ridge 66 is positioned on an interior side of the cutout portion 62. Each side panel 50 has an edge positioned in abutment to a side of the ridge 66 such that the side panel 50 extends into the cutout portion 62.

A pair of side panel connection members 68 are provided. Each side panel connection member 68 is generally U-shaped for positioning adjacent the ridge 66 of an associated one of the side members 22. A plurality of side panel connectors 67 are provided for coupling an associated one of the side panel connection members 68 to the associated side member 22. Thus, each side panel 50 is coupled to the frame assembly 20.

Each side member slot 35 has upwardly turned ends. Thus, opposite end portions of the support member 40 are curved upwardly.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An infant support assembly comprising:

a frame assembly;

a support member coupled to said frame assembly such that said support assembly is adapted for supporting an infant in spaced relationship to a surface supporting said frame assembly;

said support member having a plurality of apertures for facilitating free flow of air through said support member;

a pair of side panels coupled to said frame assembly, each side member having a plurality of apertures for facilitating free flow of air through said side members;

said frame assembly including a pair of longitudinal side members and a pair of cross members extending between associated ends of said side members to define an opening in said frame assembly;

said support member being coupled to said cross members such that said support member is positioned in said opening in said frame assembly;

each side member having a generally U-shaped cutout portion extending along a medial portion of said side member; and each said side panel being positioned in said U-shaped cutout portion of an associated one of said side members.

2. The infant support assembly of claim 1, further comprising:

said support member having longitudinal sides, each of said longitudinal sides being coupled to an associated one of said side members of said frame assembly.

3. The infant support assembly of claim 1, further comprising:

said support member being constructed from a flexible inelastic sheet of material.

4. The infant support assembly of claim 1, further comprising:

said frame assembly having a plurality of leg members, each of said leg members extending downwardly from an underside of an associated one of said longitudinal side members.

5. The infant support assembly of claim 4, further comprising:

each of said leg member having an extension portion and a support portion, said extension portion extending outwardly from a medical portion of said support portion whereby each said leg member is generally T-shaped.

6. The infant support assembly of claim 5, further each support having a longitudinal axis extending parallel to a longitudinal axis of said associated one of said longitudinal side members of said frame assembly.

7. The infant support assembly of claim 1, further comprising:

each side member having a ridge extending into said cutout portion, each ridge being positioned on an interior side of said cutout portion;

each said side panel having an edge positioned in abutment to a side of said ridge such that said side panel extends into said cutout portion;

a pair of side panel connection members, each side panel connection member being generally U-shaped for positioning adjacent said ridge of an associated one of said side members; and a plurality of side panel connectors, each side panel connector being for coupling an associated one of said side panel connection members to said associated side member whereby said side panel is coupled to said frame assembly.

8. The infant support assembly of claim 1, further comprising:

said support member having longitudinal sides, each of said longitudinal sides being coupled to an associated one of said side members of said frame assembly;

said support member being constructed from a flexible inelastic sheet of material;

said frame assembly having a plurality of leg members, each of said leg members extending downwardly from an underside of an associated one of said longitudinal side members;

each of said leg members having an extension portion and a support portion, said extension portion extending outwardly from a medial portion of said support portion whereby each said leg member is generally T-shaped;

each support portion having a longitudinal axis extending parallel to a longitudinal axis of said associated one of said longitudinal side members of said frame assembly;

each cross member having a cross member slot, an associated end of said support member being positioned in said cross member slot;

a pair of end connection members, each end connection member being insertable into an associated one of said cross member slots;

a plurality of connectors, each connector being for coupling an associated one of said end connection members to said associated one of said cross members such that said associated end of said support member is clamped between said cross member and said associated end connection member whereby said support member is coupled to said frame;

each said cross member slot extending a full length between said side members;

each said associated end of said support member being positioned to extend said full length between said side members whereby a full length of each end of said support member is coupled to said frame assembly;

each longitudinal side member having a side member slot, an associated side of said support member being positioned in said side member slot;

a pair of side connection members, each side connection member being insertable into an associated one of said side member slots;

a plurality of side connectors, each side connector being for coupling an associated one of said side connection members to said associated one of said side members such that said associated side of said support member is clamped between said side member and said associated side connection member whereby said support member is coupled to said frame;

each said side member slot extending a full length between said cross members;

each said associated side of said support member being positioned to extend said full length between said cross members whereby a full length of each side of said support member is coupled to said frame assembly;

each said end connection member fitting into said associated cross member slot such that an exterior face of said end connection member is flush with a face of said cross member when said end connection member is coupled to said cross member;

each said side connection member fitting into said associated side member slot such that an exterior face of said side connection member is flush with a face of said side member when said side connection member is coupled to said side member;

each side member having a ridge extending into said cutout portion, each ridge being positioned on an interior side of said cutout portion;

each said side panel having an edge positioned in abutment to a side of said ridge such that said side panel extends into said cutout portion;

a pair of side panel connection members, each side panel connection member being generally U-shaped for positioning adjacent said ridge of an associated one of said side members;

a plurality of side panel connectors, each side panel connector being for coupling an associated one of said side panel connection members to said associated side member whereby said side panel is coupled to said frame assembly; and each side member slot having upwardly turned ends whereby opposite end portions of said support member are curved upwardly.

9. An infant support assembly comprising:

a frame assembly;

a support member coupled to said frame assembly such that said support assembly is adapted for supporting an infant in spaced relationship to a surface supporting said frame assembly;

said support member having a plurality of apertures for facilitating free flow of air through said support member;

said frame assembly including a pair of longitudinal side members and a pair of cross members extending between associated ends of said side members to define an opening in said frame assembly;

said support member being coupled to said cross members such that said support member is positioned in said opening in said frame assembly;

each cross member having a cross member slot, an associated end of said support member being positioned in said cross member slot;

a pair of end connection members, each end connection member being insertable into an associated one of said cross member slots; and a plurality of end connectors, each end connector being for coupling an associated one of said end connection members to said associated one of said cross members such that said associated end of said support member is clamped between said cross member and said associated end connection member whereby said support member is coupled to said frame assembly.

10. The infant support assembly of claim 9, further comprising:

each said cross member slot extending a full length between said side members; and each said associated end of said support member being positioned to extend said full length between said side members whereby a full length of each end of said support member is coupled to said frame assembly.

11. The infant support assembly of claim 9, further comprising:

each said end connection member fitting into said associated cross member slot such that an exterior face of said end connection member is flush with a face of said cross member when said end connection member is coupled to said cross member.

12. An infant support assembly comprising:

a frame assembly;

a support member coupled to said frame assembly such that said support assembly is adapted for supporting an infant in spaced relationship to a surface supporting said frame assembly;

said support member having a plurality of apertures for facilitating free flow of air through said support member;

a pair of side panels coupled to said frame assembly, each side member having a plurality of apertures for facilitating free flow of air through said side members;

said frame assembly including a pair of longitudinal side members and a pair of cross members extending between associated ends of said side members to define an opening in said frame assembly;

said support member being coupled to said cross members such that said support member is positioned in said opening in said frame assembly;

each longitudinal side member having a side member slot, an associated side of said support member being positioned in said side member slot;

a pair of side connection members, each side connection member being insertable into an associated one of said side member slots; and a plurality of side connectors, each side connector being for coupling an associated one of said side connection members to said associated one of said side members such that said associated side of said support member is clamped between said side member and said associated side connection member whereby said support member is coupled to said frame assembly.

13. The infant support assembly of claim 12, further comprising:

each said side member slot extending a full length between said cross members; and each said associated side of said support member being positioned to extend said full length between said cross members whereby a full length of each side of said support member is coupled to said frame assembly.

14. The infant support assembly of claim 12, further comprising:

each said side connection member fitting into said associated side member slot such that an exterior face of said side connection member is flush with a face of said side member when said side connection member is coupled to said side member.

15. The infant support assembly of claim 12, further comprising:

each side member slot having upwardly turned ends whereby opposite end portions of said support member are curved upwardly.

* * * * *